US006446476B1

(12) United States Patent
Gmurowski

(10) Patent No.: US 6,446,476 B1
(45) Date of Patent: Sep. 10, 2002

(54) HYDROFORMING METHOD AND APPARATUS

(75) Inventor: Romuald Gmurowski, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/998,674

(22) Filed: Nov. 30, 2001

(51) Int. Cl.[7] ..... B21D 22/10; B21D 39/20
(52) U.S. Cl. ..... 72/58; 72/61
(58) Field of Search ..... 72/58, 61, 62, 72/367

(56) References Cited

U.S. PATENT DOCUMENTS 3,350,905 A * 11/1967 Ogura et al. ..... 72/62
4,317,348 A * 3/1982 Halene et al. ..... 72/58
5,865,054 A * 2/1999 Roper ..... 72/62
5,918,494 A * 7/1999 Kojima et al. ..... 72/58
6,029,487 A * 2/2000 Genin et al. ..... 72/58
6,041,633 A * 3/2000 Bieling ..... 72/58

* cited by examiner

*Primary Examiner*—David Jones
(74) *Attorney, Agent, or Firm*—Charles E. Leahy

(57) ABSTRACT

Hydroforming method and apparatus are disclosed for preventing or minimizing thinning of a tubular part during its hydroforming in a die cavity. Seal units are employed which each have a docking rod that sealing docks at one end with the tubular part and is counterbalanced or overpowered at an opposite end with the same hydroforming pressure that acts in the tubular part on the docking end so that a hydraulic piston that operates the docking rod need only develop sufficient force to exceed the yield strength of the tubular part to effect its compression between the docking rods and thereby effect the addition of material in the tubular part to the portions of the tubular part being stretched during hydroforming.

2 Claims, 2 Drawing Sheets

HYDROFORMING METHOD AND APPARATUS

TECHNICAL FIELD

This invention relates to method and apparatus for hydroforming metal parts and more particularly to the seal units employed in the hydroforming which are operable to compress the parts between their ends to prevent or minimize thinning of the parts during their hydroforming.

BACKGROUND OF THE INVENTION

As is well known in the hydroforming art, like devices commonly referred to as "seal units" are located at opposite ends of a tubular metal part to be hydroformed. The seal units are then simultaneously advanced by separate hydraulically operated actuators, also called feed mechanisms, to sealing dock with the ends of the tubular part. And this docking of the seal units may be either before or after the part is fully enclosed in a hydroforming die cavity. The thus sealed tubular part is then filled with a hydroforming fluid by a passage through the seal units while the part is fully enclosed in the die cavity and this fluid is then pressurized sufficiently to force the tubular part to stretch outward and conform to the die cavity. Examples of such prior method and apparatus are disclosed in U.S. Patents 5,233,854; 5,233,856 and 5,321,964 assigned to the assignee of this invention.

While such prior method and apparatus have proven generally satisfactory, it is commonly known that the stretching of the metal in the hydroforming of the part causes its wall to thin and thus weaken. And this can present a strength problem depending on the thickness or gage of the tubular part and its intended usage. In any event, it is generally desirable regardless of the end use of the hydroformed part to make the best use of the part's material provided there is not some overriding factor. For example, in attempting to solve this wall-thinning problem, there may be a substantial cost penalty involved or some other impracticality such as limited space in the hydroforming apparatus for some form of means to compensate for this problem.

One known form of apparatus for preventing or minimizing wall thinning of a hydroformed part which is not provided for in the abovementioned U.S. Patents is shown and labeled as "Prior Art" in FIG. 1 of the accompanying drawings. In this apparatus, there is provided a seal unit generally designated as 10 located at each end of a tubular metal part 12 to be hydroformed in a die set 14 comprising an upper die 16 and lower die 18 that cooperatively define a die cavity 20 about the part. Only one such seal unit is shown and it will be understood that a like seal unit is located at the other end of the part.

Each seal unit includes a hydraulically operated seal unit actuating mechanism comprising a hydraulic cylinder 22 in which a piston 24 is received and has a piston rod 26 projecting outward of the cylinder. A rod 28 commonly called a docking rod is connected at one end to the projecting end of the piston rod 26 and is adapted at the opposite end to dock with and sealing engage the respective end of the tubular part as shown. This occurs when hydraulic fluid at a predetermined pressure is delivered through a port 30 to a chamber 32 at one end of the piston while a chamber 34 at the other end of the piston is exhausted of hydraulic fluid through a port 36.

Still referring to FIG. 1, hydroforming fluid is then supplied to fill the thus sealed tubular part through a passage 38 in the docking rod and with the hydraulic pressure on the piston 24 sufficient at this stage of operation to maintain the sealing to prevent leakage of the hydroforming fluid. When the tubular part is filled with hydroforning fluid, the pressure on this fluid is then increased causing the tubular part to expand and conform to the die cavity surface stretching from its initial shape shown in solid lines to the expanded shape shown in phantom lines. At the same time, the hydraulic pressure in chamber 32 acting on the piston 24 is increased to maintain sealing of the hydroforming fluid in the part. And as the tubular part expands, its wall thickness will begin to thin since a fixed amount of material (metal) must now stretch to a new larger dimension.

To reduce and possibly eliminate such wall thinning, the hydraulic pressure in chamber 32 acting on the piston 24 is increased so that sufficient force is developed on the docking rod exceeding the yield strength of the tubular part. And this forces the tubular part to shorten thereby causing metal flow to the expanding tube portion to prevent or minimize its thinning. Following hydroforming of the part, the hydroforming fluid is exhausted through the passage 38 in each seal unit and the seal units are then separated or un-docked from the part by exhausting the chamber 32 and supplying the other chamber 34 in each seal unit with hydraulic pressure to retract their docking rod. After which, the die set is opened to remove the hydroformed part.

The apparatus in FIG. 1 does however require a very large hydraulically operated seal actuating mechanism for each seal unit because it must not only be required to develop a force exceeding the yield strength of the part to be hydroformed, it must also have the ability to overpower the high pressure of the hydroforming fluid in the part tending to un-dock or separate the seal units from the part during the hydroforming operation. And this pressure can reach 25,000 psi and more depending on the part being formed. In addition, there are safety standard limitations on the amount of hydraulic pressure that can be employed in a manufacturing facility. For example, the hydraulic pressure may be limited to 3000 psi for safety reasons. These standards may be self imposed by the manufacturer or government mandated but in either event, they can require increasing the size of the hydraulically operated seal actuating mechanism far beyond what would be required if the hydraulic pressure only had to produce sufficient force to adequately exceed the yield strength of the part being hydroformed.

Large hydraulically operated actuating mechanisms (hydraulic cylinder and piston) are very expensive and possibly even more important, they may not fit the available space in existing hydroforming apparatus and therefore require totally new apparatus to accommodate their large size.

SUMMARY OF THE INVENTION

The present invention in method and apparatus for hydroforming a tubular part provides for minimizing the size of the hydraulically operated seal actuating mechanism required to exceed the yield strength of the tubular part for the purpose of minimizing or prevent thinning of the part as it is hydroformed. This is accomplished in a very simple, low-cost manner with hydroforming apparatus comprising a pair of like seal units which are positioned in conventional manner at the opposite ends of the tubular part to be hydroformed. Each seal unit comprises a hydraulic cylinder, a doubleended hydraulic piston received in the hydraulic cylinder, a hydraulic chamber at each end of the hydraulic piston, a docking rod cylinder, and a docking rod that is located centrally of and rigidly joined at an intermediate axial location to the hydraulic piston.

The docking rod is received at one end in the docking rod cylinder and at the other end projects outwardly of the seal unit and is adapted at the latter end to dock with and sealingly engage the respective end of the tubular part to be hydroformed. And a hydroforming fluid passage is provided in each seal unit that is open to a fluid chamber in the docking rod cylinder at the one end of the docking rod and extends centrally through the docking rod to deliver hydroforming fluid to both this fluid chamber and the interior of the tubular part following the docking of the seal units with the part. With such docking being effected by the supply of hydraulic fluid under pressure to one of the hydraulic chambers while the other hydraulic chamber is exhausted.

The one end of the docking rod exposed to the hydroforming pressure in the fluid chamber in the docking rod cylinder has a pressure responsive area at least equal to or greater than that of the sealing end of the docking rod end acted on by the hydroforming fluid pressure in the tubular part that is forcing the latter to expand and conform to the die cavity. As a result, the hydroforming fluid pressure force acting outward on the seal units is counterbalanced or can even be overpowered by the hydroforming pressure acting in the opposite direction in the seal units on their docking rod as the latter pressure is raised to form the part. And as the hydraulic pressure acting on the hydraulic piston in the seal units is raised to yield or compress the part between its ends to minimize or prevent thinning of the part.

And thus the hydraulic piston in the seal units, by being relieved of having to counteract the hydroforming pressure force acting outward on the seal units, only needs to develop sufficient force in order to yield the tubular part to cause its shortening and thereby add material to the wall of the part being stretched to minimize or prevent its thinning. As a result, the hydraulic cylinder and piston for each seal unit can be considerably smaller than what would be required without the counterbalancing or overpowering hydroforming pressure force compensating feature described above.

It is therefore an object of the present invention to provide new and improved method and apparatus for minimizing the hydraulic force required to yield a part during its hydroforming to minimize or prevent thinning of the wall of the part as it is stretched.

Another object of the present invention is to provide a new and improved, simple, compact, low cost hydroforming method and apparatus by counterbalancing the force from the hydroforming pressure in the part acting outward on the seal units to minimize the size of the hydraulically operated mechanism required to yield the tube to prevent or minimize thinning of the wall of the part during hydroforming.

These and other objects, advantages and features of the present invention will become more apparent from the following description and accompanying drawings.

DESCRIPTION OF EXEMPLARY EMBODIMENTS

Figure 2:
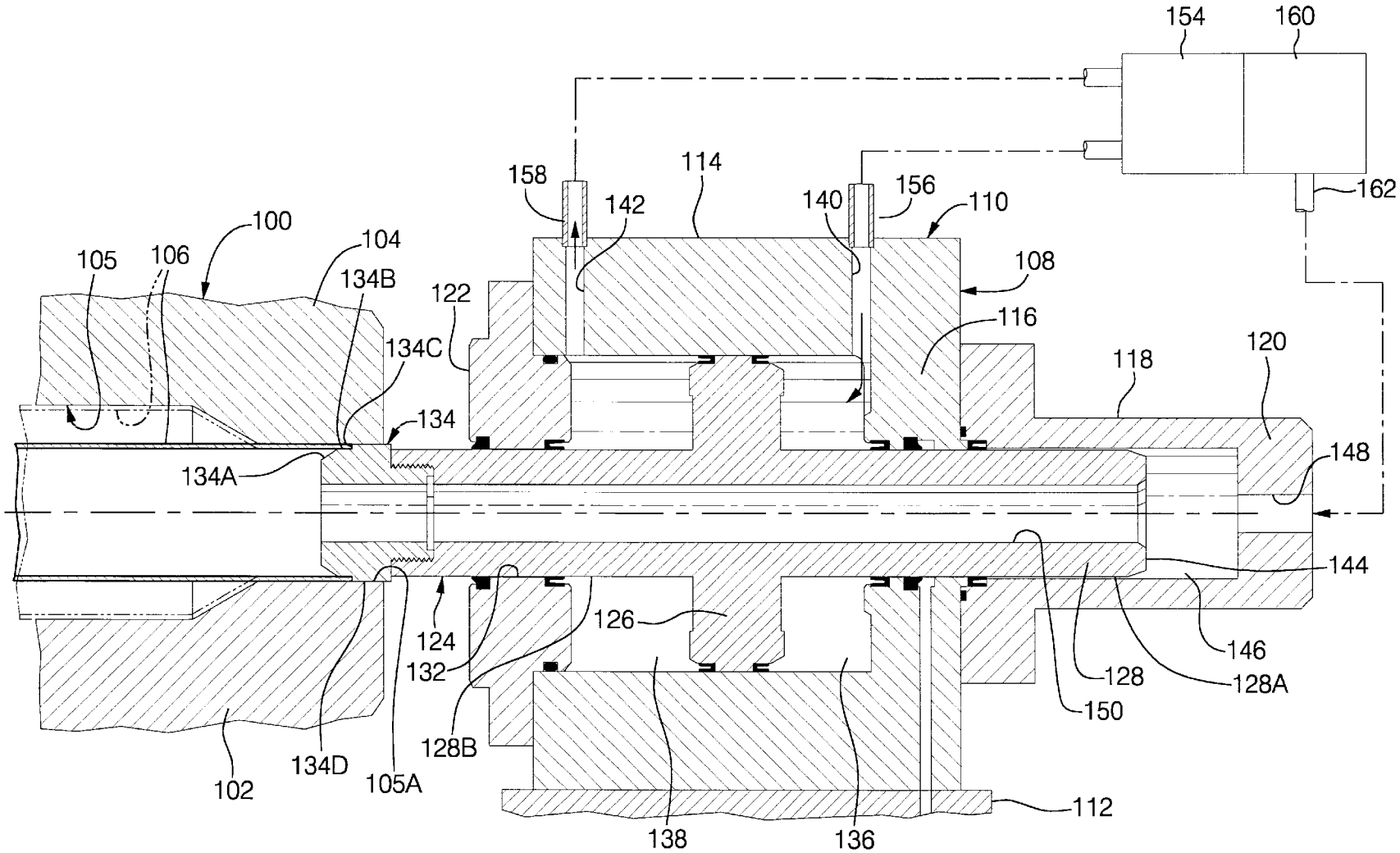
FIG. 2 is a partial sectioned side view of an exemplary embodiment of the hydroforming apparatus according to the present invention.

Referring to FIG. 2, there is shown hydroforming apparatus that includes a hydroforming die set 100 comprising a lower die 102 and an upper die 104. The dies 102 and 104 cooperatively define a die cavity 105 with cylindrical openings 105A (only one such opening being shown) capturing a tubular metal part 106 to be formed, such part having been positioned between the dies prior to their having been pressed together by a die operating portion (not shown) of the apparatus which may be of any suitable conventional type. The die cavity openings 105A capture the ends of the part and provide access to the interior thereof for the hydroforming fluid as described later. And the part to be formed may for example be a frame member for a motor vehicle where both strength and weight of the part are important factors.

Hydroforming of the part 106 in the die cavity 105 is performed with a pair of like seal units which are located at opposite ends of the part, only one such seal unit together with the right hand end of the part being shown and with such seal unit being generally designated as 108. And it will be understood in the detailed description of the seal unit 108 and its interaction with the part 106 that follows, such description equally applies to the other seal unit and that the two seal units operate conjointly and simultaneously to form the part.

As shown in FIG. 2, the seal unit 108 comprises a housing generally designated as 110 that is rigidly fixed to a base portion 112 of the apparatus in a location opposite the associated one end of the tubular part 106. The housing 110 comprises a hydraulic cylinder 114 having an integral end cap 116 at one end, a docking rod cylinder 118 having an integral end cap 120 at one end and fixed at the other end to the cylinder end cap 116, and a separate end cap 122 fixed to the other end of the hydraulic cylinder 114. And it will be understood that the separate parts forming the housing 110 are fixed together and to the base portion 112 by suitable fastener means (not shown) such as bolts and cap screws. The seal unit housing 110 is fixed in position on the base portion 112 with the outer side of end cap 122 facing directly opposite the respective end of the die set 100. And it will also be understood that the base portion 112 supporting the seal unit 108 in the apparatus may itself be fixed in position in the apparatus or movable to and from the position shown by conventional seal unit positioning devices to facilitate accessing the die set and/or loading a part in the die set.

A one-piece, hydraulic piston/docking rod member 124 is mounted for reciprocal movement in the housing 110 and comprises a double-ended hydraulic piston 126 and a cylindrical docking rod 128 of smaller diameter that is integral with and extends in opposite axial directions from the center of the piston. The hydraulic piston 126 is received in the hydraulic cylinder 114 while one cylindrical end portion 128A of the docking rod 128 is received in the docking rod cylinder 118 and the other cylindrical end portion 128B is received in a cylindrical bore 132 in the end cap 122 coaxial with the docking rod cylinder 118 and extends outward of this end cap. The docking rod portions 128A and 128B are provided with the same diameter as the inner diameter of the part and particularly the docking rod portion 128A for the purpose of counterbalancing as described later. And with the end portion 128A thus constituting an oppositely extending extension of a conventional docking rod like in FIG. 1 that extends from only one end of the hydraulic piston.

The projecting end of the docking rod end portion 128B is adapted to dock with and sealing engage the respective end of the tubular part by the provision of a collar 134 that is threadably fastened to this end. The collar 134 has a conical end 134A that terminates at a cylindrical step 134B having a radial shoulder 134C that extends radially outward to a cylindrical piloting portion 134D. The diameter of the step 134B and radial dimension of the shoulder 134C correspond to the inner diameter and wall thickness of the tubular part, respectively, and the diameter of the piloting portion 134D is slightly less than the diameter of the cylindrical openings 105A of the die cavity. On extension of the docking rod, the piloting portion 134D is closely received in the respective die cavity opening 105A and thereafter pilots collar movement wherein the conical end 134A enters the end of the part and guides the step 134B into the tube end with an interference fit while the piloting portion 134D eventually guides the shoulder 134C into engagement with the annular end edge of the tubular part. With such operation thus providing metal-to-metal sealing between the docking rod collar and the part.

The hydraulic piston 126 and cylinder 114, cylinder cap 116 and docking rod end portion 128A cooperatively form an annular chamber 136 at one end of the hydraulic piston 126 for seal unit docking operation by the hydraulic piston. And the hydraulic piston 126 and cylinder 114, docking rod end portion 128B and end cap 122 cooperatively form an annular chamber 138 at the other end of the hydraulic piston 126 for seal unit undocking (retracting) operation by the hydraulic piston. For such hydraulic piston operation, entry-exit ports 140 and 142 provide hydraulic fluid entry to and exit from the chambers 136 and 138, respectively, in the wall of the hydraulic cylinder 114.

The docking rod cylinder 118, end cap 120 and the end 144 of the docking rod end portion 128A cooperatively define a fluid chamber 146 that is open to a centrally located hydroforming fluid entry-exit port 148 in the end cap 120. And a hydroforming fluid entry-exit passage 150 formed by a bore extending axially through the center of the docking rod end portions 128A, 128B, hydraulic piston 126 and collar 134 provides for entry and exit of hydroforming fluid with respect to the interior of the tubular part while the seal unit is sealingly docked therewith. In the seal unit assembly above described there are several potential paths for leakage and suitable seals of conventional type are shown at these sites as shown in FIG. 2 but are not designated by reference numbers.

During hydroforming of the part, the hydroforming pressure developed in the part 106 also acts on the exposed end area of the collar 134 thus creating a very substantial force tending to force the docking rod 128 to retract and thus break the sealed engagement of the seal unit with the part. This force, which increases in direct proportion to increasing hydroforming pressure, is counterbalanced or overpowered by making the pressure responsive area at the end 144 of the docking rod end portion 128A at least equal to or greater than that of the collar 134 exposed to the hydroforming pressure in the tubular part.

Operation of the seal units 108 is provided by a hydraulic fluid system 154 with variable pressure control and selective delivery and exhaust control that employs oil and is connected by hydraulic lines 156 and 158 to the hydraulic entry-exit ports 140 and 142 respectively in each seal unit. And for the hydroforming operation and force assistance in the seal units 108, there is provided a hydroforming fluid system 160 also with variable pressure control and selective delivery and exhaust control that employs a high water based liquid solution as the hydroforming fluid and is connected by a hydraulic line 162 to the hydroforming entry-exit port 148 in each seal unit.

Describing now the operation of the above apparatus following closure of the tubular part 106 in the die set and with both seal units 108 in their operating position, hydraulic fluid such as oil is delivered at a predetermined relatively low pressure by the hydraulic system 154 to the hydraulic chamber 136 in both seal units 108 while the other hydraulic chamber 138 in the seal units is opened to exhaust by the hydraulic system. This pressure on the hydraulic piston 126 in the seal units forces their docking rod 128 to extend to the position shown engaging their docking rod collar 134 with the respective end of the tubular part 106. This results in both seal units 108 pushing on the ends of the part with a preload force sufficient at this low hydraulic pressure to create metal-to-metal sealing between the tube ends and the docking rod collars. Hydroforming fluid is then delivered by the hydroforming system 160 to fill the tubular part 106 and also the fluid chamber 146 in both seal units. Both the hydraulic pressure and the hydroforming fluid pressure are then increased by the hydraulic and hydroforming systems 154 and 160, respectively, with the latter pressure being increased sufficiently to form the part to the die cavity and the hydraulic pressure being increased sufficiently to maintain the sealing and also compress or shorten the tubular part between its ends and thereby add material to the wall portions of the part being stretched to prevent or minimize their thinning.

Following hydroforming of the part whereby the part has been stretched from the shape shown in solid lines to that shown in phantom lines, the hydroforming fluid is exhausted from the seal units through the entry-exit port 148 by the hydroforming system 160. And hydraulic fluid is delivered by the hydraulic system 154 to the hydraulic chamber 138 in both seal units while their other hydraulic chamber 136 is exhausted by the latter system thereby causing retraction of their docking rod 128 to clear their collar 134 from the finished part.

Figure 1:
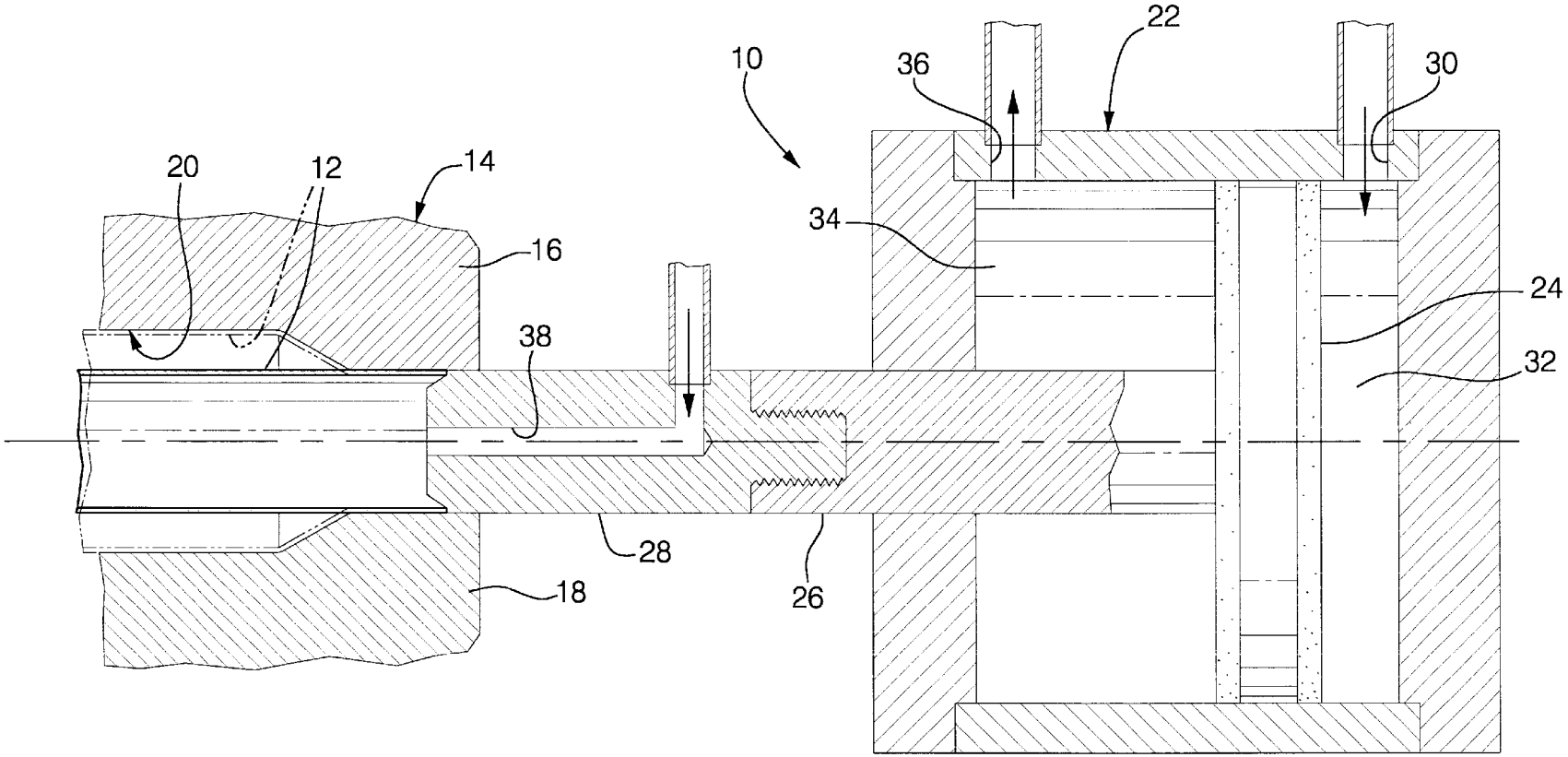
PRIOR ART FIG. 1
FIG. 1 is a partial sectioned side of the "Prior Art" previously described.

Considering the magnitude of the forces required in the above operations of the present invention for an exemplary part and comparing same with that required in the prior art apparatus in FIG. 1, it will be assumed that the outer diameter of the tubular part prior to hydroforming is 2.750 inches and that the tube wall thickness is 0.080 inches resulting in a cross-sectional tube area of 0.671 square inches. It will also be assumed that the yield strength of tube material is 50,000 psi. Therefore, in order to compress or yield the tube between its ends, there will be required a force of at least 33,550 pounds. And this is therefore the absolute minimum force that the prior art hydraulic piston 24 in FIG. 1 would have to produce just to yield the tube.

Further assuming that the hydroforming pressure will reach 25,000 psi in forming the part and again referring to the prior art in FIG. 1, it will be seen that this 25,000 psi pushes outward on the end of the docking rod 28 as well as the interior of the part. If the pressure responsive area of the docking rod 28 is 5.268 square inches, there is thus created a back driving force on the docking rod of 131,713 pounds. And therefore the piston 24 in FIG. 1 must produce 165,263 pounds of force (131,713 +33,550), which is almost five times the minimum force required to yield the tube. If the hydraulic pressure is limited for example to 3000 psi for safety reasons as is known to be the case in many manufacturing plants, the diameter of the piston 24 in FIG. 1 would need to be 8.375 inches without any safety factor.

With the present invention, the hydroforming pressure pushing back on the collar 134 and thus on the docking rod in the seal units 108 is counterbalanced by this same pressure simultaneously acting on an equal size area at the opposite end 144 of the docking rod with the result that the hydraulic piston 126 in the seal units 108 only needs to develop enough force to yield the tube, i.e. it does not have to overcome the hydroforming pressure back-force on the docking rod. Moreover, this countering force can be made to overpower this back-force, if desired, by simply increasing the diameter of the docking rod portion 128A and accordingly its cylinder 118 to increase the pressure responsive area of the docking rod end 144.

Again assuming theoretical minimums and with no safety factor, the hydraulic piston 126 in the seal units 108 would require a diameter of only 4.576 inches as compared with the much larger 8.375 inch diameter that would be required for the FIG. 1 piston 24 and cylinder 22. Furthermore, if a surplus of force is desired to ensure sufficient power reserves to adequately feed material by the compression or yielding of the tubular part during its hydroforming as well as overcome high friction losses between the part and the dies, the hydraulic piston force can be more than doubled with the available oil pressure indicated above while still maintaining a significant advantage in compactness over the prior art seal unit in FIG. 1.

It will be appreciated by those skilled in this art that the above-described embodiments of the method and apparatus of the present invention are intended to adequately disclose and teach the present invention and that various modifications can be made without departing from the invention. For example, the collar 134 is shown as a separate piece attached to the docking rod 128 with the latter formed integral with the hydraulic piston 126. Alternatively, the collar could be made integral with the docking rod and thus the hydraulic piston 126, and the docking rod 128 could be made as a separate piece extending through the center of the hydraulic piston and suitably fixed thereto.

Moreover, there are other possible modifications that will likely become apparent to those skilled in this art from the above disclosure and therefore it is intended that the scope of the present invention is to be limited only by the scope of the appended claims.

What is claimed is:

1. Hydroforming seal unit comprising a first cylinder, a second cylinder directly joined to said first cylinder, a multifunctional member having a double-ended piston portion and first and second rod portions of equal diameter projecting in opposite axial directions from the center of said piston portion, said piston portion received in said first cylinder, said first rod portion received in said second cylinder, said second rod portion extending outward of said first cylinder and adapted to sealingly dock with an end of a tubular part to be hydroformed by operation of said piston portion, first and second annular chambers in said first cylinder extending about and formed in part by said first and second rod portions respectively, said second rod portion having a pressure response area exposed to the interior of the tubular part while docked therewith, a third chamber in said second cylinder open to an end of said first rod portion wherein said end has a pressure responsive pressure compensating area at least equal to that of said second rod portion, means for selectively delivering hydraulic fluid under pressure to and exhausting hydraulic fluid from said first and second chambers to operate said piston and thereby said second rod portion for docking and retracting with respect to the tubular part, means for selectively delivering hydroforrning fluid under pressure to and exhausting the hydroforming fluid from said third chamber, and said rnultifunctional member having a hydroforming fluid passage extending there through and open to said third chamber for cooperating with said third chamber to deliver hydroforming fluid to and exhaust the hydroforning fluid from the interior of the tubular part when said second rod portion is sealingly docked with the tubular part.

2. A hydroforming, seal unit as defined in claim 1 wherein said second rod portion is adapted with a replaceable collar fastened thereto for sealingly docking with the tubular part and wherein said collar has a cylindrical end portion with a diameter substantially equal to the inner diameter of the tubular part and an adjoining cylindrical portion with a diameter substantially equal to the outer diameter of the tubular part and wherein said rod portions have a diameter at least substantially equal to the inner diameter of the tubular part.

* * * * *